US007347286B2

(12) United States Patent
Hu

(10) Patent No.: US 7,347,286 B2
(45) Date of Patent: Mar. 25, 2008

(54) DRILL STRING VALVE ASSEMBLY

(75) Inventor: Guoqiang Hu, Calgary (CA)

(73) Assignee: Tesco Corporation, Calgary (CA)

( * ) Notice: Subject to any disclaimer, the term of this patent is extended or adjusted under 35 U.S.C. 154(b) by 316 days.

(21) Appl. No.: 10/907,901

(22) Filed: Apr. 20, 2005

(65) Prior Publication Data

US 2005/0236191 A1 Oct. 27, 2005

Related U.S. Application Data

(60) Provisional application No. 60/521,513, filed on May 10, 2004, provisional application No. 60/521,430, filed on Apr. 23, 2004.

(51) Int. Cl.
*E21B 17/00* (2006.01)

(52) U.S. Cl. ..... 175/218; 175/325.1; 175/325.5

(58) Field of Classification Search ..... 166/77.52, 166/85.1, 86.1, 78.1, 95.1; 175/162, 152, 175/113, 195, 203, 325.1, 325.5, 218
See application file for complete search history.

(56) References Cited

U.S. PATENT DOCUMENTS 4,479,547 A * 10/1984 Boyadjieff et al. ..... 166/383
4,625,755 A * 12/1986 Reddoch ..... 137/327
4,781,359 A * 11/1988 Matus ..... 267/71
5,165,493 A * 11/1992 Baugh ..... 175/218
5,479,988 A * 1/1996 Appleton ..... 166/325
6,637,526 B2 * 10/2003 Juhasz et al. ..... 175/52
7,163,064 B2 * 1/2007 Moncus et al. ..... 166/379
2001/0045285 A1 * 11/2001 Russell ..... 166/332.3
2002/0129934 A1 * 9/2002 Mullins et al. ..... 166/90.1
2006/0060360 A1 * 3/2006 Moncus et al. ..... 166/386
2007/0039758 A1 * 2/2007 Klipstein ..... 175/113

* cited by examiner

*Primary Examiner*—David Bagnell
*Assistant Examiner*—Robert E. Fuller
(74) *Attorney, Agent, or Firm*—Bennet Jones LLP

(57) ABSTRACT

A drill string valve assembly includes a tubular valve body, including an outer surface and an inner bore for housing a valve mechanism to control fluid flow through the bore; and an axial load support releasably securable to the outer surface of the valve body, the axial load support including an upper releasable load bearing connection to the tubular body and a lower releasable load bearing connection to the tubular valve body.

44 Claims, 4 Drawing Sheets

DRILL STRING VALVE ASSEMBLY

FIELD OF THE INVENTION

The invention relates to a drill string valve assembly and an apparatus for increasing the load carrying capabilities of a drill string valve.

BACKGROUND

In some drilling operations, a top drive is suspended in a rig and a casing engaging and drive assembly is positioned therebelow. These tools support the drill string and may rotationally and axially drive it. These tools also permit circulation of drilling fluid through the drill string. A drill string valve may be incorporated in these tools.

In one embodiment, a drill string valve is incorporated in the top drive below the quill and may support an actuator thereabout. The valve is sometime termed a mud saver valve and may include one or more valve mechanisms for controlling drilling fluid flow to the drill string. Drill string valves used in top drive drilling operations are generally remotely functioned by an actuator. During a drilling operation, the valve because of its position in the stem below the quill of the top drive, may be required to support the weight of the drill string and to deliver the drilling torque to the string. Due to the dimensional constraints of typical actuators and the presence of stem or other holes in the valve, the valve may have an inherent weakness. In some applications, the combined load conditions including bending, axial weight and torque load conditions under which the valve is required to operate have caused the valve to fail, for example about its valve stem openings.

Another valve body dimensional obstacle is the need to provide for stripping the valve into the hole or casing being drilled through.

Since the valve is positioned above the drill floor, it may be desirable or necessary to achieve a particular rating for the valve, for example, of API8C. However, due to the above-noted constraints, it has been difficult to achieve such a desired API rating.

SUMMARY OF THE INVENTION

A drill string valve assembly is described herein which may be useful to increase the load that may be supported by the valve, while retaining the valve's ability to be stripped into the borehole/casing.

In accordance with one aspect of the present invention, there is provided a drill string valve assembly comprising: a tubular body, including an outer surface and an inner bore for housing a valve mechanism to control fluid flow through the bore; and an axial load support releasably securable to the outer surface of the valve body, the axial load support including an upper releasable load bearing connection to the tubular body and a lower releasable load bearing connection to the tubular body.

In accordance with another aspect of the present invention, there is provided a drill string valve axial load support comprising: a body releasably securable to a drill string valve body, an upper and a lower releasable load bearing connections on the body for releasably engaging the drill string valve body.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1:
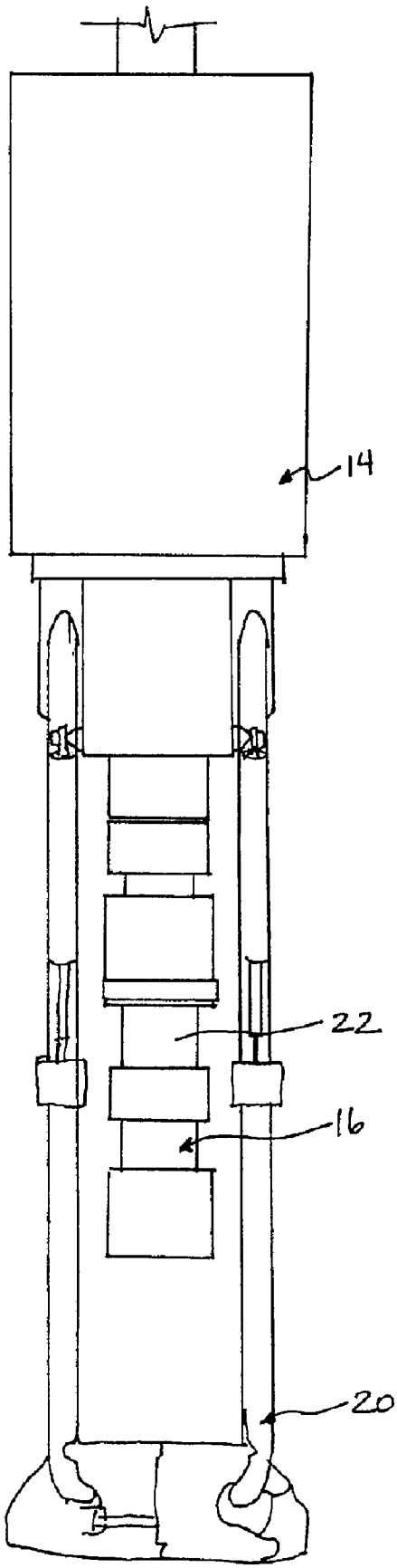
FIGURE 1 prior art
FIG. 1 is a side elevation of a top drive drilling assembly.

FIG. 1 shows one typical top drive drilling assembly for a drilling operation. The top drive drilling assembly may be installed in a rig (not shown). The top drive drilling assembly includes a torque drive system 14 and a tubular section 16 leading to the drill string engagement mechanism (not shown). The assembly may also include pipe-handling mechanisms 20.

In the illustrated embodiment, a drill string valve 22 is positioned in the tubular section. During a drilling operation drilling fluid flows through valve 22 and such flow may be shut down by the one or more valve mechanisms in the valve. Because of its position in the drilling assembly, valve 22 may be subject to high combined axial, bending and torque loads. At the same time, the outer diameter of valve 22 should not be such that stripping into the hole or casing is affected adversely.

Figure 2A:
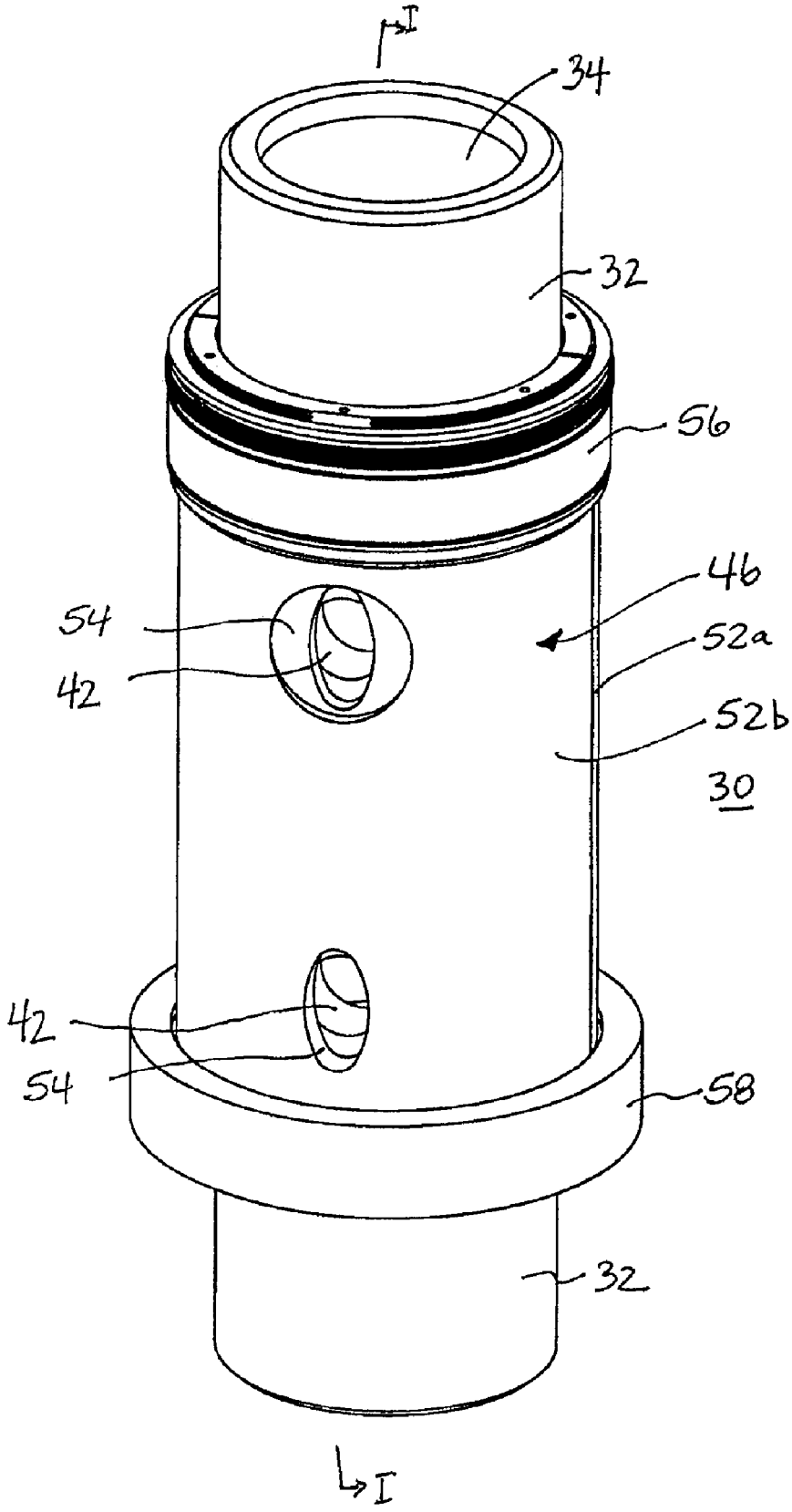
FIG. 2A is a perspective view of a drill string a drill string valve assembly.
Figure 2B:
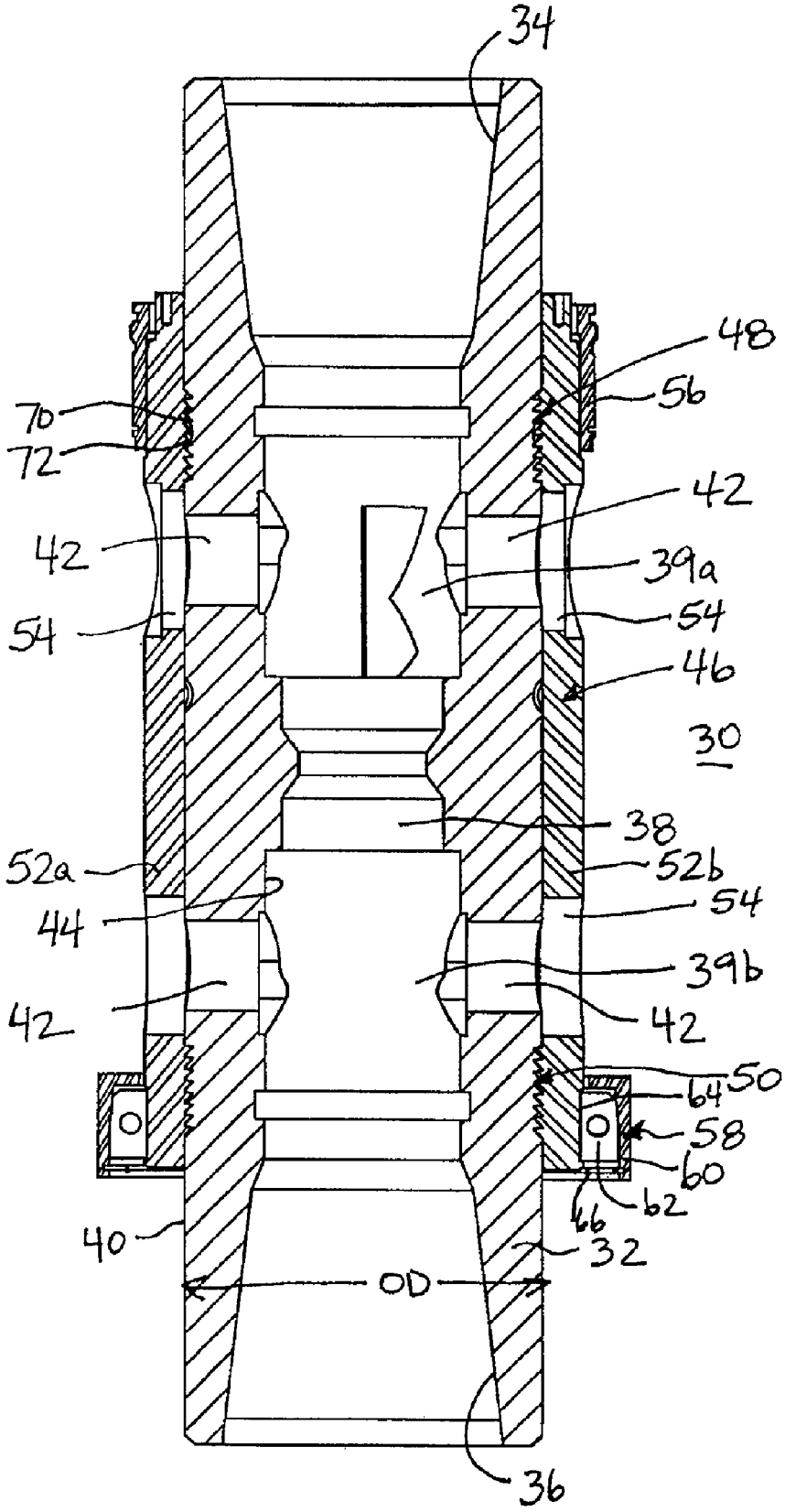
FIG. 2B is a section along line l-l of FIG. 2A.
Figure 2C:
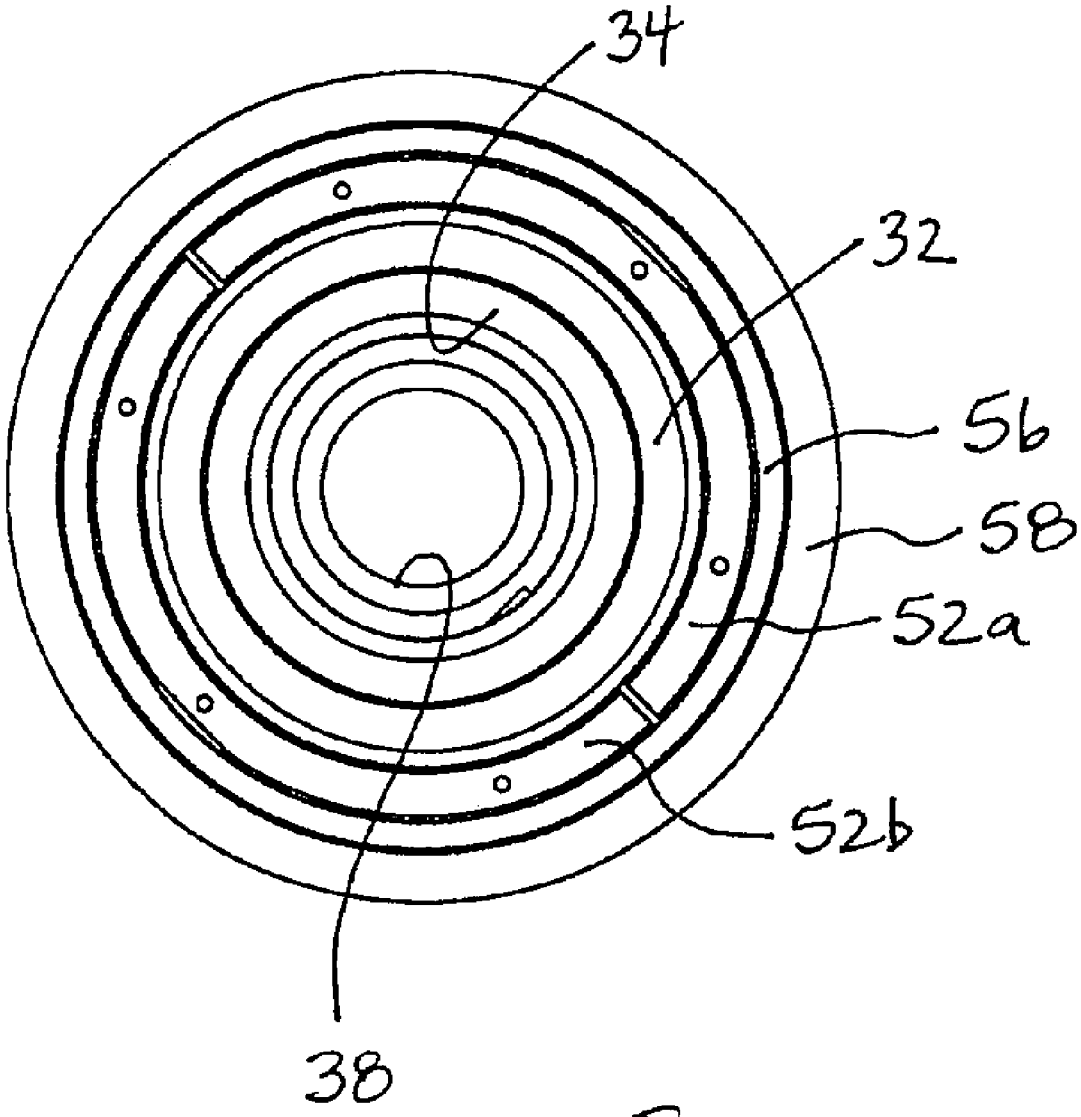
FIG. 2C is an end view of the drill string valve assembly of FIG. 2A.

With reference to FIG. 2 a drill string valve assembly 30 is shown that may have increased load carrying capacity over many previous drill string valves and remains strippable.

Drill string valve assembly 30 includes a tubular valve body 32 including an upper end and a lower end. The tubular valve body may be formed in any desired way for connection into or below the top drive drilling assembly, as by threaded upper connection 34 and lower connection 36. Tubular valve body 32 includes an inner bore 38 formed for housing at least one valve mechanism (not shown) to control fluid flow through the inner bore. While the illustrated tubular valve body 32 is formed to accommodate two valve mechanisms, at 39*a*, 39*b*, it is to be understood that the valve body may accommodate one or more valve mechanisms.

Tubular valve body 32 further includes an outer surface 40. To be strippable into the hole or casing through which a borehole is being drilled, the valve body should be configurable to have an outer diameter OD defined by its outer surface that is substantially similar to the outer diameter of the drill string being manipulated by the top drive.

The valve mechanisms to be accommodated in the valve body may require forms or structures such as valve stem holes 42, enlarged inner bore diameters 44, etc. to be formed in or through the valve body. These structures may cause high stress concentrations where cracks, especially fatigue failure may occur.

Thus, drill string valve assembly 30 may further include an axial load support 46 releasably securable to outer surface 40 of the valve body. The axial load support includes an upper releasable load bearing connection 48 to the tubular body and a lower releasable load bearing connection 50 to the tubular body. Upper releasable load bearing connection 48 and lower releasable load bearing connection 50 are formed to react therebetween expansive axial loads from the valve body such that if desired, the load can be shared between the valve body and the axial support during normal operation. Therefore, the load carrying capacity of the overall valve assembly may be increased over a valve body alone. Also, should the valve body weaken and/or fail, the axial loads on the valve, such as the string weight, can be taken up by the axial load support to prevent the drill string and/or overhead equipment from becoming disconnected and dropping onto the rig floor or into the hole. In one embodiment, for example, the axial load support may be selected to have an API 8c axial load rating of at least 500 ton.

In one embodiment, the upper releasable load bearing connection can be positioned adjacent the valve body upper end and the lower releasable load bearing connection can be positioned adjacent the lower end of the valve body. In another embodiment, the axial load support is formed to span weak points along the valve body such as at valve stem holes 42 and, as such, upper releasable load bearing connection 48 may be positioned above the valve stem holes and lower releasable load bearing connection 50 may be positioned below valve stem holes 42.

The axial load support may take various forms. In the illustrated embodiment of FIGS. 2, the axial load support is formed as a split sleeve including a first sleeve axial section 52*a* and a second sleeve axial section 52*b* that together closely surround the OD of the valve. The sleeve includes openings 54 for access to valve stem holes 42 or other valve parts.

The split sleeve axial sections 52*a*, 52*b* may be releasably connected about the valve body such that they can be removed if desired. For example, the outer diameter of the overall assembly including axial load support and valve body, may have an overall outer diameter that would prevent the valve from being stripped. Thus, the sections of the axial load support may be readily releasable from the valve body to reduce the outer diameter of the valve assembly to prepare to strip the valve. In the illustrated embodiment, for example, axial sections 52*a*, 52*b* are each formed to encircle ½ or less of the valve body circumference so that they can be removed readily from the valve body.

The axial sections of the split sleeve can be secured about the valve body in various releasable ways, as by clamps, latches, fasteners, welding, etc. In one embodiment, attachment of the axial load support to the valve body is provided by means that are quickly releasable, as by use of clamps, latches, fasteners, etc., so that the axial load support can be quickly removed to render the valve body ready for stripping into the hole (i.e. having an OD sized to strip into the hole). In the illustrated embodiment of FIGS. 2, the axial sections are secured about the valve body by ring clamps positionable over the ends of the sleeve. In particular, the illustrated embodiment includes an upper ring 56 positionable over an upper end of the sleeve and a lower ring 58 positionable over the lower end of the sleeve, when the axial sections are assembled. The rings may be releasably secured by frictional engagement, wedging, setscrews, c-rings, threading, etc. In the illustrated embodiment, upper ring 56 is threaded over an upper end of the split sleeve. Lower ring 58, as illustrated, includes an outer, continuous retainer ring 60 and an inner packer 62. Inner packer 62 engages in a gland 64 on the outer surface of sleeve sections 52 and outer ring 60 overlies the packer and is secured by a c-ring 66. To remove lower ring 58, c-ring 66 may be removed, ring 60 slid up away from over the packer and the packer removed such that ring 60 can be slid off of the sleeve.

Of course other forms of axial load supports may be provided, for example, a full sleeve can be provided that is releasable from the valve body by sliding axially from over the valve. Such a sleeve could be slid over the valve body and twisted to lock using the upper and lower load bearing connections including for example axially interlocking shoulders. In another embodiment, the axial load support may be formed by a plurality of independent links each securable adjacent one end to the valve body at an upper releasable load bearing connection and adjacent an opposite end at a lower releasable load bearing connection.

The upper and lower releasable load bearing connections may also take various forms. For example, in the illustrated embodiment of FIGS. 2, upper and lower releasable load bearing connections are formed by circumferentially extending interlocking teeth 70 and grooves 72. The teeth and grooves may be angled to engage against release of the valve body from the axial load support when one or both of these parts are axially loaded in expansion. For example, the teeth on the valve body at the upper connection may be angled upwardly toward the valve body upper end, while the teeth on the valve body at the lower connection may be angled downwardly so that if the valve body should fail, the valve body cannot pull out of the two ends of the axial load support.

Alternately or in addition, other upper and lower releasable load bearing connections are contemplated such as interlocking shoulders or interlocking protrusions and recesses. Each of the connections may extend continuously, or be positioned at spaced positions, between the valve body and axial load support.

The axial load support may be modified in various ways, for example, to be integrated with a valve actuator, to support an actuator for a top drive or other drive assembly, etc.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

What is claimed is:

1. A drill string valve axial load support comprising: a body releasably securable to a drill string valve body, the body being formed as a split sleeve including a first sleeve axial section and a second sleeve axial section that together surround the valve body OD, an upper releasable load bearing connection on the body for releasably engaging the drill string valve body and a lower releasable load bearing connection on the body for releasably engaging the drill string valve body, the upper releasable load bearing connection and the lower releasable load bearing connection together formed to accept axial load transfer from the drill string valve body.

2. The drill string valve axial load support of claim 1 wherein the axial load support is selected to have an API 8c axial load rating of at least 500 ton.

3. The drill string valve axial load support of claim 1 wherein body includes openings for access to valve body components.

4. The drill string valve axial load support of claim 1 wherein the first sleeve axial section and the second sleeve axial section are each formed to encircle at most of the valve body circumference.

5. The drill string valve axial load support of claim 1 further comprising releasable clamps for releasably securing the first sleeve axial section and the second sleeve axial section about the valve body.

6. The drill string valve axial load support of claim 5 wherein the releasable clamps are secured by at least one of frictional engagement, wedging, setscrews, c-rings or threading.

7. The drill string valve axial load support of claim 5 wherein the releasable clamps are ring clamps positionable over the ends of the first and second axial sleeve sections when they are assembled about the valve body.

8. The drill string valve axial load support of claim 7 wherein the ring clamps are secured by at least one of frictional engagement, wedging, setscrews, c-rings or threading.

9. The drill string valve axial load support of claim 1 wherein the lower releasable load bearing connection includes teeth and grooves formed on the body to interlock with corresponding teeth and grooves formed on the valve body.

10. The drill string valve axial load support of claim 9 wherein the teeth and grooves and the corresponding teeth and grooves are at least in part angled to engage against release of the valve body from the load support when axially loaded in expansion.

11. The drill string valve axial load support of claim 9 wherein the teeth and grooves extend circumferentially between the load support body and the valve body.

12. The drill string valve axial load support of claim 1 wherein the axial load support is integrated with a drive assembly for use in pipe handling.

13. The drill string valve axial load support of claim 12 wherein the drive assembly includes an actuator for a top drive or for the valve.

14. A drill string valve assembly comprising: a tubular valve body, including an outer surface and an inner bore for housing a valve mechanism to control fluid flow through the bore; and an axial load support releasably securable to the outer surface of the valve body, the axial load support including an upper releasable load bearing connection to the tubular body and a lower releasable load bearing connection to the tubular valve body.

15. The drill string valve assembly of claim 14 wherein the valve body includes at least one valve stem hole and the upper releasable load bearing connection and the lower releasable load bearing connection are positioned on either sides of the at least one valve stem holes.

16. The drill string valve assembly of claim 14 wherein the axial load support is selected to have an API 8c axial load rating of at least 500 ton.

17. The drill string valve assembly of claim 14 wherein the body is formed as a sleeve with an inner bore and is mounted about the valve body with the valve body extending through the bore of the sleeve.

18. The drill string valve assembly of claim 14 wherein the valve body includes components on its outer surface and the axial load support includes openings for access to the valve body components.

19. The drill string valve assembly of claim 14 wherein the axial load support is formed as a split sleeve including a first sleeve axial section and a second sleeve axial section that together surround the valve body OD.

20. The drill string valve assembly of claim 19 wherein the first sleeve axial section and the second sleeve axial section are each formed to encircle at most ½ of the valve body circumference.

21. The drill string valve assembly of claim 19 further comprising releasable clamps for releasably securing the first sleeve axial section and the second sleeve axial section about the valve body.

22. The drill string valve assembly of claim 21 wherein the releasable clamps are secured by at least one of frictional engagement, wedging, setscrews, c-rings or threading.

23. The drill string valve assembly of claim 21 wherein the releasable clamps are ring clamps positionable over the ends of the first and second axial sleeve sections when they are assembled about the valve body.

24. The drill string valve assembly of claim 23 wherein the ring clamps are secured by at least one of frictional engagement, wedging, setscrews, c-rings or threading.

25. The drill string valve assembly of claim 14 wherein the lower releasable load bearing connection includes teeth and grooves formed on the axial load support to interlock with corresponding teeth and grooves formed on the valve body.

26. The drill string valve assembly of claim 25 wherein the teeth and grooves and the corresponding teeth and grooves are at least in part angled to engage against release of the valve body from the axial load support when axially loaded in expansion.

27. The drill string valve assembly of claim 25 wherein the teeth and grooves extend circumferentially between the axial load support and the valve body.

28. The drill string valve assembly of claim 14 wherein the axial load support is integrated with a drive assembly for use in pipe handling.

29. The drill string valve assembly of claim 28 wherein the drive assembly includes an actuator for a top drive or for the valve mechanism.

30. The drill string valve assembly of claim 14 connected below a top drive for pipe handling.

31. A drill string valve axial load support comprising: a body releasably securable to a drill string valve body, the body being formed as a sleeve with an inner bore and is mounted about the valve body with the valve body extending through the bore of the sleeve, an upper releasable load bearing connection on the body for releasably engaging the drill string valve body and a lower releasable load bearing connection on the body for releasably engaging the drill string valve body, the upper releasable load bearing connection and the lower releasable load bearing connection together formed to accept axial load transfer from the drill string valve body.

32. The drill string valve axial load support of claim 31 wherein the axial load support is selected to have an API 8c axial load rating of at least 500 ton.

33. The drill string valve axial load support of claim 31 wherein the axial load support is integrated with a drive assembly for use in pipe handling.

34. The drill string valve axial load support of claim 33 wherein the drive assembly includes an actuator for a top drive or for the valve.

35. A drill string valve axial load support comprising: a body releasably securable to a drill string valve body, the body including openings for access to valve body components, an upper releasable load bearing connection on the body for releasably engaging the drill string valve body and a lower releasable load bearing connection on the body for releasably engaging the drill string valve body, the upper releasable load bearing connection and the lower releasable load bearing connection together formed to accept axial load transfer from the drill string valve body.

36. The drill string valve axial load support of claim 35 wherein the axial load support is selected to have an API 8c axial load rating of at least 500 ton.

37. The drill string valve axial load support of claim 35 wherein the axial load support is integrated with a drive assembly for use in pipe handling.

38. The drill string valve axial load support of claim 37 wherein the drive assembly includes an actuator for a top drive or for the valve.

39. A drill string valve axial load support comprising: a body releasably securable to a drill string valve body, an upper releasable load bearing connection on the body for releasably engaging the drill string valve body and a lower releasable load bearing connection on the body for releasably engaging the drill string valve body, the upper releasable load bearing connection and the lower releasable load bearing connection together formed to accept axial load transfer from the drill string valve body, the lower releasable load bearing connection including teeth and grooves formed on the body to interlock with corresponding teeth and grooves formed on the valve body.

40. The drill string valve axial load support of claim 39 wherein the teeth and grooves and the corresponding teeth and grooves are at least in part angled to engage against release of the valve body from the load support when axially loaded in expansion.

41. The drill string valve axial load support of claim 39 wherein the teeth and grooves extend circumferentially between the load support body and the valve body.

42. The drill string valve axial load support of claim 39 wherein the axial load support is selected to have an API 8c axial load rating of at least 500 ton.

43. The drill string valve axial load support of claim 39 wherein the axial load support is integrated with a drive assembly for use in pipe handling.

44. The drill string valve axial load support of claim 43 wherein the drive assembly includes an actuator for a top drive or for the valve.

* * * * *